United States Patent [19]

Knight, Jr.

[11] 4,134,532

[45] Jan. 16, 1979

[54] TRAY WITH INTERLOCKING END FLANGES

[75] Inventor: Onis A. Knight, Jr., Hurst, Tex.

[73] Assignee: Container Corporation of America, Chicago, Ill.

[21] Appl. No.: 876,522

[22] Filed: Feb. 10, 1978

[51] Int. Cl.[2] ..... B65D 5/26; B65D 5/22

[52] U.S. Cl. ..... 229/32; 229/35

[58] Field of Search ..... 229/32, 33, 35

[56] References Cited

U.S. PATENT DOCUMENTS

| | | | |
|---|---|---|---|
| 711,813 | 10/1902 | Austin et al. | 229/32 |
| 743,205 | 11/1903 | Tupper et al. | 229/32 |
| 2,993,633 | 7/1961 | Keller | 229/33 |
| 3,246,830 | 4/1966 | Smith | 229/32 |
| 3,342,401 | 9/1967 | Kitchell | 229/35 |
| 3,499,596 | 3/1970 | McCormick | 229/32 |
| 3,944,129 | 3/1976 | McCall et al. | 229/32 |
| 4,034,907 | 7/1977 | Engdahl, Jr. | 229/32 |

*Primary Examiner*—Davis T. Moorhead
*Attorney, Agent, or Firm*—Carpenter & Ostis

[57] ABSTRACT

A one-piece, open top, tray type container having flanges on the end walls which engage upper portions of the side walls to form an interlocking connection therebetween which does not require outside securing means.

2 Claims, 4 Drawing Figures

TRAY WITH INTERLOCKING END FLANGES

SUMMARY OF THE INVENTION

This invention relates to open top, tray type containers and more particularly to an improved container formed of a one-piece blank of foldable paperboard which does not require any outside means such as adhesives or staples for securing the end walls to the side walls.

A more specific object of the invention is to provide, in a shipping container of the type described, flange means carried by the end walls which flange means include pockets for receiving upper portions of the side walls at the corners of the container to provide an interlocking connection therebetween and thereby eliminate the need for outside securing means such as adhesives, staples, or the like.

Other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 1:
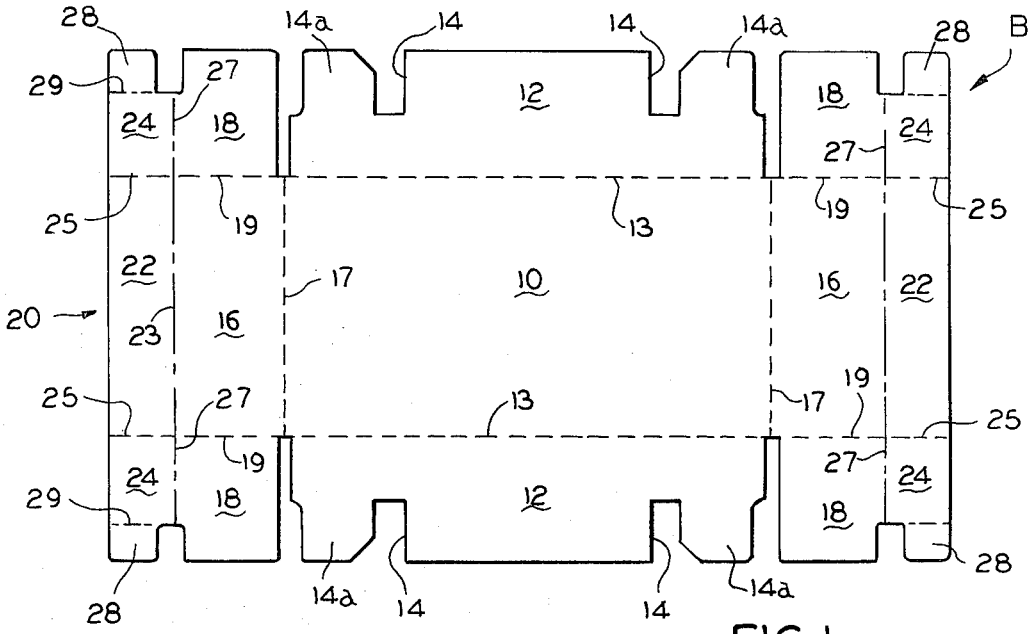
FIG. 1 is a plan view of a blank of foldable paperboard from which the container illustrated in the other views may be formed.
Figure 3:
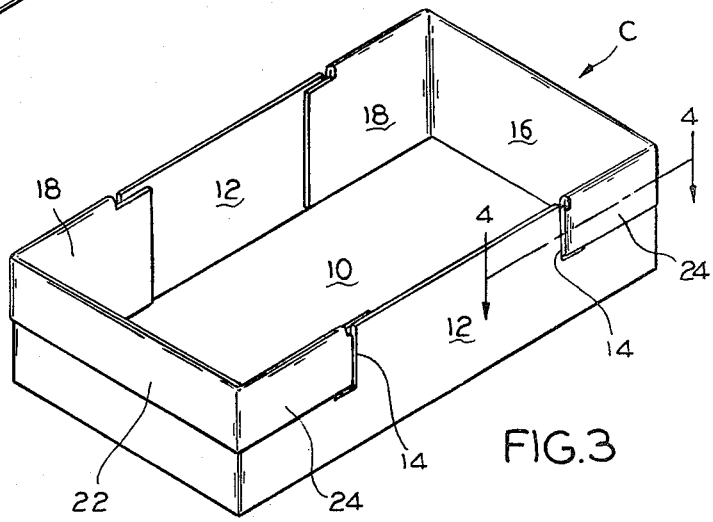
FIG. 3 is a perspective view of a container embodying features of the invention, as shown in the fully erected condition.

Referring now to the drawings for a better understanding of the invention, it will be seen that an open top, tray type shipping container, indicated generally at C in FIG. 3, may be formed from a unitary blank B of foldable paperboard as illustrated in FIG. 1.

Container C includes a preferably rectangular bottom wall 10 having opposed pairs of side walls 12 and end walls 16 foldably joined to opposite side and end edges thereof along fold lines 13 and 17, respectively, and disposed to extend upward therefrom to form a boxlike structure open at the top.

Each of the end walls 16 has a pair of corner flaps 18 foldably joined to opposite side edges thereof along fold lines 19, and, when the carton is in erected condition, the corner flaps 18 are folded inwardly and normal to the end walls 16 and are disposed to lie against the inner faces of adjacent end portions of related side walls 12.

Figure 2:
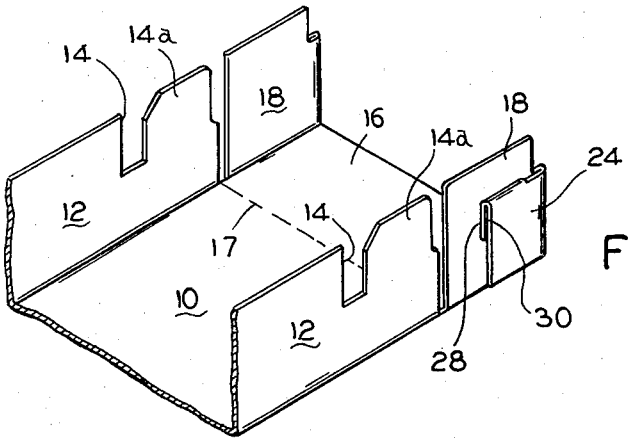
FIG. 2 is a fragmentary, perspective view of a portion of the structure illustrated in FIG. 1 which is shown in a partially erected condition.

As best seen in FIGS. 1 and 2, each of the side walls 12 includes a pair of generally vertically extending openings or slots 14 which are located inboardly from opposite ends of the side wall and which separate side wall end portions 14*a* from the main or center portion of the side wall.

In order to secure the end walls of the container to the side walls, without the necessity for outside securing means such as adhesive or staples, there is provided at each end of the container a locking flange indicated generally at 20. Each locking flange 20 includes a center element 22 which is foldably joined at its upper edge along fold line 23 to the upper edge of related end wall 16 and which has a pair of outer side elements 24 foldably joined to opposite side edges thereof along fold lines 25. Each of the outer side elements 24 is also foldably joined at its upper edge along a fold line 27 to the upper edge of related corner flap 18. Additionally, each outer side element 24 has a locking element 28 foldably joined to another side edge thereof along a fold line 29.

To erect the container, side walls 12 are folded upwardly at right angles to the plane of bottom wall. Each locking flange 20 is then reverse folded 180 degrees to lie against the outer face of related end wall 12 and corner flaps 18. Corner flaps 18 together with related side and locking elements 24 and 28 are then folded upwardly at right angles to the plane of the bottom wall 10 and at the same time locking elements 28 are each folded inwardly 180 degrees to lie between its related corner flap 18 and side element 24, as illustrated in FIG. 2.

Figure 4:
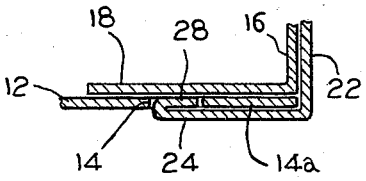
FIG. 4 is a fragmentary, horizontal section taken on line 4—4 of FIG. 3.

At this time each end wall 16 is folded upwardly at right angles to the plane of the bottom wall 10 and also at right angles to the planes of side walls 12, with the corner flaps 18 disposed to lie against the inner faces of respective side wall end portions 14*a*, with side elements 24 disposed to lie against the outer faces of respective side wall end portions 14*a*, and with locking elements 28 received within related slots 14 of the respective side walls 12, as illustrated in FIGS. 3 and 4, to provide an integral interlocking connection between the end and side walls of the container.

Thus, it will be appreciated that the container is of relatively simple design and construction which may be shipped in a flattened condition and may be readily assembled by hand without any need for securing equipment such as adhesive appliers or stapling equipment.

I claim:

1. In a one piece, open top, tray type container, having a bottom wall and opposed pairs of side and end walls foldably joined to and upstanding from opposed side and end edges, respectively, of said bottom wall, integral means for interlockingly connecting said end walls to said side walls at the corners of said container without requiring outside securing means, comprising;

(a) each of said side walls including a pair of generally vertically extending slots spaced inboardly from the ends thereof between a center portion of the side wall and a pair of end portions thereof;

(b) corner flaps foldably joined to opposed side edges of said end walls and folded normal thereto so as to lie against inner faces of respective side walls;

(c) connecting flange members at opposed ends of the container each including:

(i) a center element foldably joined at its upper edge to the upper edge of a related end wall and folded downwardly to lie against the outer face of said end wall;

(ii) a pair of side elements, each foldably joined at its upper edge to an upper edge of a related corner flap, foldably joined at its outboard edge to a related side edge of said center element, and folded downwardly to lie against the outside face of said related corner flap;

(iii) locking elements foldably joined to inboard edges of respective side elements and being folded to lie against inner faces thereof;

(iv) each of said locking elements being positioned within a related slot of an adjacent side wall and, together with the related end portion of said adjacent side wall, being interposed between a related corner flap and side element to provide an integral, interlocking connection between the side and end wall.

2. In a one piece, open top, tray type container, having a bottom wall and opposed pairs of side and end walls foldably joined to and upstanding from opposed side and end edges, respectively, of said bottom wall, integral means for interlockingly connecting said end walls to said side walls at the corners of said container without requiring outside securing means, comprising;

(a) each of said side walls including a pair of openings spaced inboardly from opposite ends thereof;

(b) corner flaps foldably joined to opposed side edges of said end walls and folded normal thereto so as to lie against inner faces of respective side walls;

(c) connecting flange members at opposed ends of the container each including:

(i) a center element foldably joined at its upper edge to the upper edge of a related end wall and folded downwardly to lie against the outer face of said end wall;

(ii) a pair of side elements, each foldably joined at its upper edge to an upper edge of a related corner flap, foldably joined at its outboard edge to a related side edge of said center element, and folded downwardly to lie against the outside face of said related corner flap;

(iii) locking elements foldably joined to inboard edges of respective side elements and being folded to lie against inner faces thereof;

(iv) each of said locking elements being positioned within a related opening of an adjacent side wall and being interposed between a related corner flap and side element to provide an integral, interlocking connection between the side and end wall.

* * * * *